US007327249B1

(12) United States Patent
Murray

(10) Patent No.: US 7,327,249 B1
(45) Date of Patent: Feb. 5, 2008

(54) BARRIER OPERATOR SYSTEM HAVING MULTIPLE FREQUENCY RECEIVERS

(75) Inventor: James S. Murray, Milton, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 93 days.

(21) Appl. No.: 10/875,415

(22) Filed: Jun. 24, 2004

(51) Int. Cl.
*G08B 19/00* (2006.01)

(52) U.S. Cl. ..... 340/521; 340/539.1; 340/825.69; 340/438; 340/825.72; 340/5.71

(58) Field of Classification Search ..... 340/521, 340/531, 539.1, 5.7, 5.1, 5.2, 5.72, 3.1, 825.69, 340/438, 445, 5.6, 5.64, 825.72, 825.71; 455/73, 550.1
See application file for complete search history.

(56) References Cited

U.S. PATENT DOCUMENTS

| | | | | |
|---|---|---|---|---|
| 4,670,906 | A * | 6/1987 | Thro | 455/525 |
| 5,285,478 | A | 2/1994 | Wornell et al. | 375/37 |
| 5,555,019 | A * | 9/1996 | Dole | 348/148 |
| 5,727,758 | A * | 3/1998 | Penza et al. | 246/124 |
| 5,737,107 | A * | 4/1998 | Umeda | 398/106 |
| 5,872,519 | A * | 2/1999 | Issa et al. | 340/825.01 |
| 5,991,331 | A | 11/1999 | Chennakeshu et al. | 375/202 |
| 6,078,271 | A | 6/2000 | Roddy et al. | 340/825.72 |
| 6,084,317 | A * | 7/2000 | Wolfe et al. | 307/10.4 |
| 6,333,698 | B1 * | 12/2001 | Roddy | 340/825.72 |
| 6,634,408 | B2 * | 10/2003 | Mays | 160/188 |
| 6,822,603 | B1 | 11/2004 | Crimmins et al. | 341/176 |
| 6,847,303 | B2 | 1/2005 | Hoermann | 340/825.73 |
| 6,915,146 | B1 * | 7/2005 | Nguyen et al. | 455/702 |
| 2005/0024254 | A1 * | 2/2005 | Chuey | |

* cited by examiner

*Primary Examiner*—Benjamin C. Lee
*Assistant Examiner*—Daniel Previl
(74) *Attorney, Agent, or Firm*—Renner Kenner Greive Bobak Taylor & Weber

(57) ABSTRACT

A barrier operator system is disclosed that is capable of receiving different wireless signals. The system includes a primary controller that is connected to a first receiver which receives a first wireless signal. And the system includes a second receiver circuit that is connected to the controller and receives a second wireless signal that is different from the first wireless signal. This allows the system to accept wireless signals from two or more different types of transmitters to allow for use of older technology transmitters with newer technology operator systems. The wireless signals may be in the form of radio frequency, infra-red, visible light or audio signals.

21 Claims, 4 Drawing Sheets

BARRIER OPERATOR SYSTEM HAVING MULTIPLE FREQUENCY RECEIVERS

TECHNICAL FIELD

Generally, the present invention relates to a movable barrier operator system for use on a closure member moveable relative to a fixed member. More specifically, the present invention relates to a barrier operator, wherein the operator is able to receive and respond to different transmitters operating at different frequencies.

BACKGROUND ART

For convenience purposes, it is well known to provide garage doors which utilize a motor to provide opening and closing movements of the door. Motors may also be coupled with other types of movable barriers such as gates, windows, retractable overhangs and the like. An operator is employed to control the motor and related functions with respect to the door. The operator receives command signals for the purpose of opening and closing the door from a wireless remote, from a wired or wireless wall station or other similar device. It is also known to provide safety devices that are connected to the operator for the purpose of detecting an obstruction so that the operator may then take corrective action with the motor to avoid entrapment of the obstruction.

All known garage door operator systems use only one radio frequency (RF) receiver. This receiver could be an external bolt-on receiver or could be integrated into a motor control board maintained within an operator housing. The RF receiver receives RF data from a remote control (portable transmitter, wall-station transmitter, etc.) to control movement of the garage door; to control the garage door operator light, other various functions or accessories (e.g. external light fixture); or to control appliances associated with a home network. These RF receivers are typically very high frequency (VHF) receivers designed to receive a manufacturer assigned frequency, such as 300.0 MHz, 315.0 MHz, 390.0 MHz, or 433.92 MHz. All of the remote controls for a specific operator transmit at the respective manufacturer assigned frequency.

There are remote controls which can transmit at multiple radio frequencies that can be used with the different manufacturers' assigned frequencies. For example, one transmitter may be provided with three buttons, wherein each button corresponds to a different manufacturer's operator RF receiver. In other words, actuation of one button transmits at 300 MHz, actuation of another button transmits at 315 MHz, and actuation of the third button transmits at 390 MHz. The following patents are exemplary of operator receiver configurations.

U.S. Pat. No. 5,285,478 to Wornell, et al. discloses a communication system in which a transmitter performs modulation upon a number sequence to be transmitted. The modulation scheme includes embedding a sequence of numbers into a waveform such that the sequence is present in the waveform on multiple time scales. The transmitted waveform has a selected number of different frequency bands of successively doubling bandwidths. Each of the frequency bands includes the sequence of numbers, repeated therein at a certain rate. The rate is directly proportional to the bandwidth of the frequency band. The communication system further includes a receiver designed to average the value of the repeated sequence as received by the receiver. This scheme allows for accurate communication over noisy, uncertain, and/or hostile channels in both point to point and broadcast communication applications. However, the scheme does not allow for the operator to receive different frequency signals.

U.S. Pat. No. 5,991,331 to Chennakeshu, et al. discloses a delay spread created in a digital radio signal to reduce the coherence bandwidth and facilitate frequency hopping to reduce the effect of fading losses within an enclosed propagation environment. The delay spread is introduced into the signal in several ways. One technique disclosed employs a transmitter with two separate antennas one of which transmits the digital signal and the other of which transmits the same signal after a phase delay has been introduced into the signal. The carrier frequency of the signals is hopped between at least two frequencies and a receiver processes the resulting signals. In another embodiment, a single transmit antenna is used but the signal is received by two different antennas with the output signal from one of those antennas being phase delayed before combining it with the other prior to processing by the single receiver circuit. Phase delay is also introduced at baseband into the signals to be transmitted by rotating the I and Q components of the waveforms before modulation.

U.S. Pat. No. 6,078,271 to Roddy, et al. discloses a programmable transmitter which includes a receiver for receiving a coded signal at a desired frequency. The code is stored in memory during a learning mode and is then retransmitted sequentially at a plurality of frequencies, including the desired frequency. During this time, the operator observes the device to be operated and indicates to the transmitter when the controlled device performs the desired function, i.e., when the desired frequency is transmitted. At that time, the operator presses a button on the transmitter, and the transmitter stores the most recently transmitted frequency. Still, only a single receiver circuit is employed.

U.S. Pat. No. 6,333,698 to Roddy discloses a trainable transmitter which includes code generation circuitry and a socket for receiving a plug-in module including circuitry for generating an RF signal. By selecting the appropriate plug-in module, the user can expand the frequency transmission range of the transmitter beyond that which may be pre-installed on the transmitter. But only a receiver capable of receiving a single frequency is disclosed.

DISCLOSURE OF INVENTION

It is thus an object of the present invention to provide a motorized barrier operator system that has multiple receivers for receiving different frequencies and a method for using the same.

In general, the present invention contemplates a barrier operator system capable of receiving different wireless signals including a primary controller, a first receiver circuit receiving a first wireless signal and connected to the primary controller, and a second receiver circuit receiving a second wireless signal and connected to the primary controller, wherein the first wireless signal is different than the second wireless signal.

The invention also contemplates a barrier operator system that provides a method for communicating wireless signals from a plurality of wireless transmitters to a barrier operator system which controls the movement of a motorized barrier between limit positions, the method including receiving one of at least two different wireless signals from the wireless transmitters, communicating the received wireless signals to an interface circuit, and processing either of the different wireless signals and generating command signals to initiate movement of the motorized barrier by the interface circuit.

The invention further contemplates a barrier operator system comprising a controller; at least two receiver circuits, each of which is connected to the controller, the at least two receiver circuits receiving wireless signals that are distinguishable from one another and which are communicated to the controller to move a barrier between limit positions.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
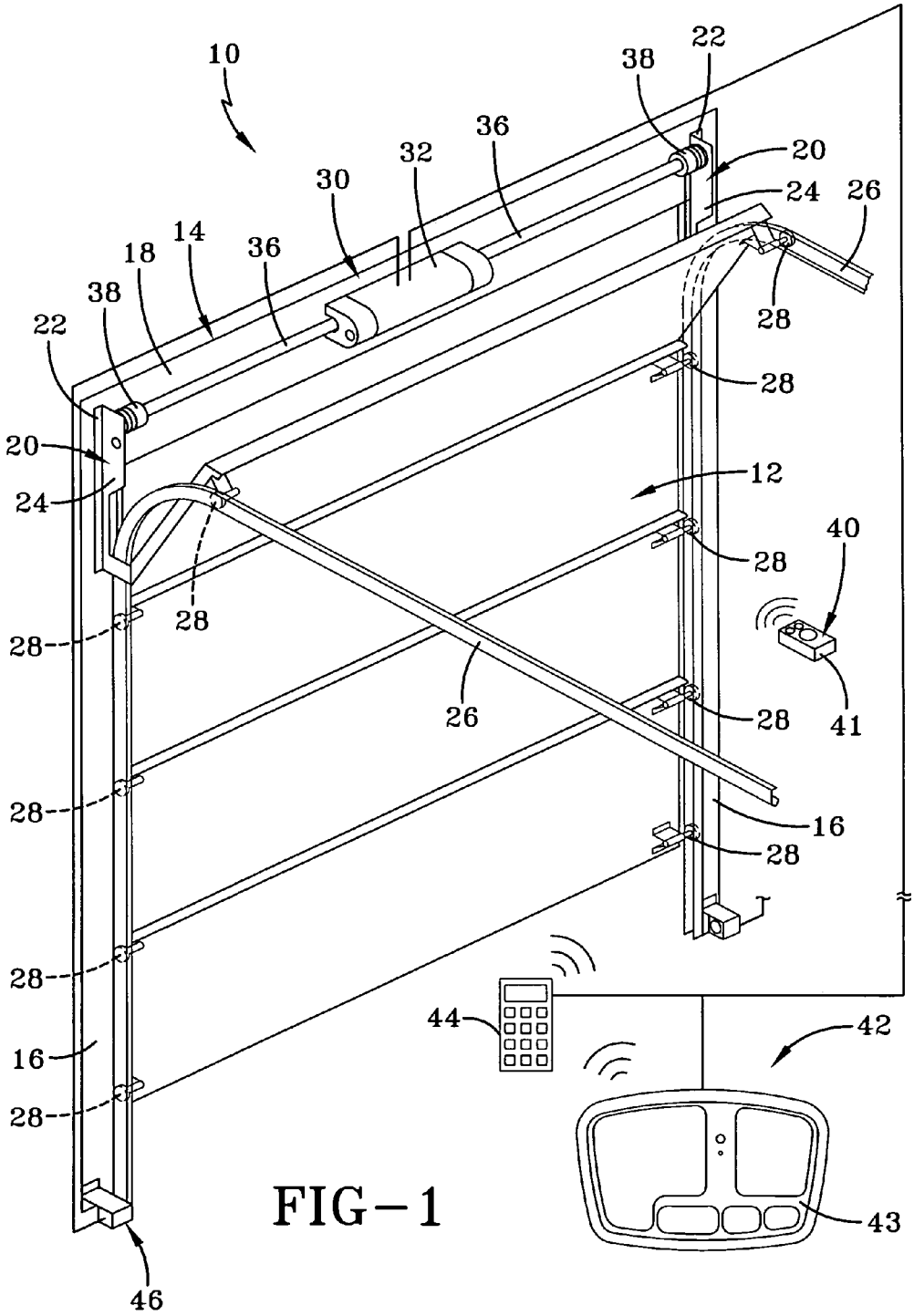
FIG. 1 is a fragmentary perspective view depicting a sectional garage door and showing an operating mechanism embodying the concepts of the present invention.

A motorized barrier operator adaptable to different safety configurations is generally indicated by the numeral 10 in FIG. 1 of the drawings. The system 10 is employed in conjunction with a conventional sectional garage barrier or door generally indicated by the numeral 12. The teachings of the present invention are equally applicable to other types of movable barriers such as single panel doors, gates, windows, retractable overhangs, and any device that at least partially encloses an area. The barrier 12 is most likely an anti-pinch type door. The opening in which the door is positioned for opening and closing movements relative thereto is surrounded by a frame, generally indicated by the numeral 14, which consists of a pair of a vertically spaced jamb members 16 that, as seen in FIG. 1, are generally parallel and extend vertically upwardly from the ground (not shown). The jambs 16 are spaced and joined at their vertically upper extremity by a header 18 to thereby form a generally u-shaped frame 14 around the opening for the barrier 12. The frame 14 is normally constructed of lumber or other structural building materials for the purpose of reinforcement and to facilitate the attachment of elements supporting and controlling the barrier 12.

Secured to the jambs 16 are L-shaped vertical members 20 which have a leg 22 attached to the jambs 16 and a projecting leg 24 which perpendicularly extends from respective legs 22. The L-shaped vertical members 20 may also be provided in other shapes depending upon the particular frame and garage door with which it is associated. Secured to each projecting leg 24 is a track 26 which extends perpendicularly from each projecting leg 24. Each track 26 receives a roller 28 which extends from the top edge of the barrier 12. Additional rollers 28 may also be provided on each top vertical edge of each section of the garage door to facilitate transfer between opening and closing positions.

Figure 2:
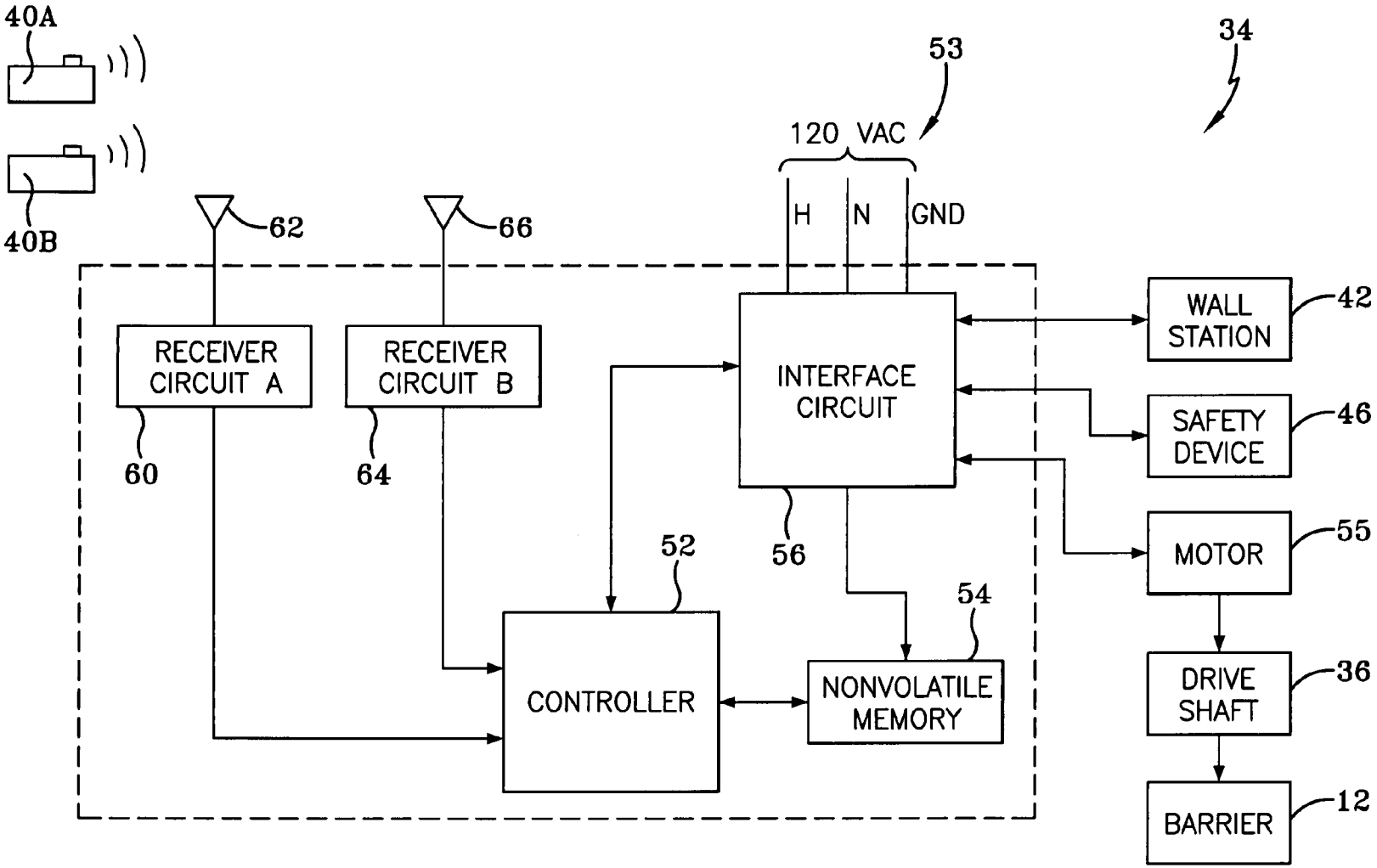
FIG. 2 is a schematic diagram of an operator mechanism.

A counterbalancing system generally indicated by the numeral 30 may be employed to move the barrier 12 back and forth between opening and closing positions. One example of a counterbalancing system is disclosed in U.S. Pat. No. 5,419,010, which is incorporated herein by reference. Generally, the counter-balancing system 30 includes a housing 32, which is affixed to the header 18 and which contains an operator mechanism generally indicated by the numeral 34 as seen in FIG. 2. Extending from each end of the operator mechanism 34 is a drive shaft 36, the opposite ends of which are received by tensioning assemblies 38 that are affixed to respective projecting legs 24. Carried within the drive shaft 36 are counterbalance springs as described in the '010 patent. Although a header-mounted operator is specifically discussed herein, the control features to be discussed later are equally applicable to other types of operators used with movable barriers. This includes, but is not limited to, trolley, jackshaft, screw-type or other header-mounted operators.

In order to move the door from an open position to a closed position or vice versa, a remote transmitter 40, a wall station transmitter 42 or a keyless entry pad transmitter 44 may be actuated. The remote transmitter 40 may use infra-red, acoustic or radio frequency signals that are received by the operator mechanism to initiate movement of the door. Likewise, the wall station 42 may perform the same functions as the remote transmitter 40 and may also provide additional functions such as the illumination of lights and provide other programming functions to enhance the manner in which the barrier is controlled. The wall station 42 and the keyless transmitter 44 may be connected directly to the operator mechanism 34 by a wire or they may employ radio frequency or infra-red signals to communicate with the operator mechanism 34. The wall station is preferably positioned within the line of sight of the barrier as it moves between positions. A hands-free transmitter may also be incorporated into the system 10. Preferably, the transmitters only generate radio frequency signals in a range of between about 300 MHz to about 450 MHz. Although the preferred transmitters only generate a single frequency signal, it will be appreciated that they may generate multiple frequencies as long as they are in the preferred range.

A safety device, designated generally by the numeral 46, is connected to the operator mechanism by a wired or wireless connection. In the preferred embodiment, the device 46 is a photo-electric eye—comprising an emitter and a receiver—mounted on opposed jambs or tracks. The device is positioned near the floor and detects the presence of any obstruction. If an obstruction is detected during movement of the barrier, then the operator mechanism initiates corrective action. Other safety devices or sensor may be connected to the operator mechanism so that it can take corrective action if an obstruction is detected or some type of system malfunction arises.

Figure 3:
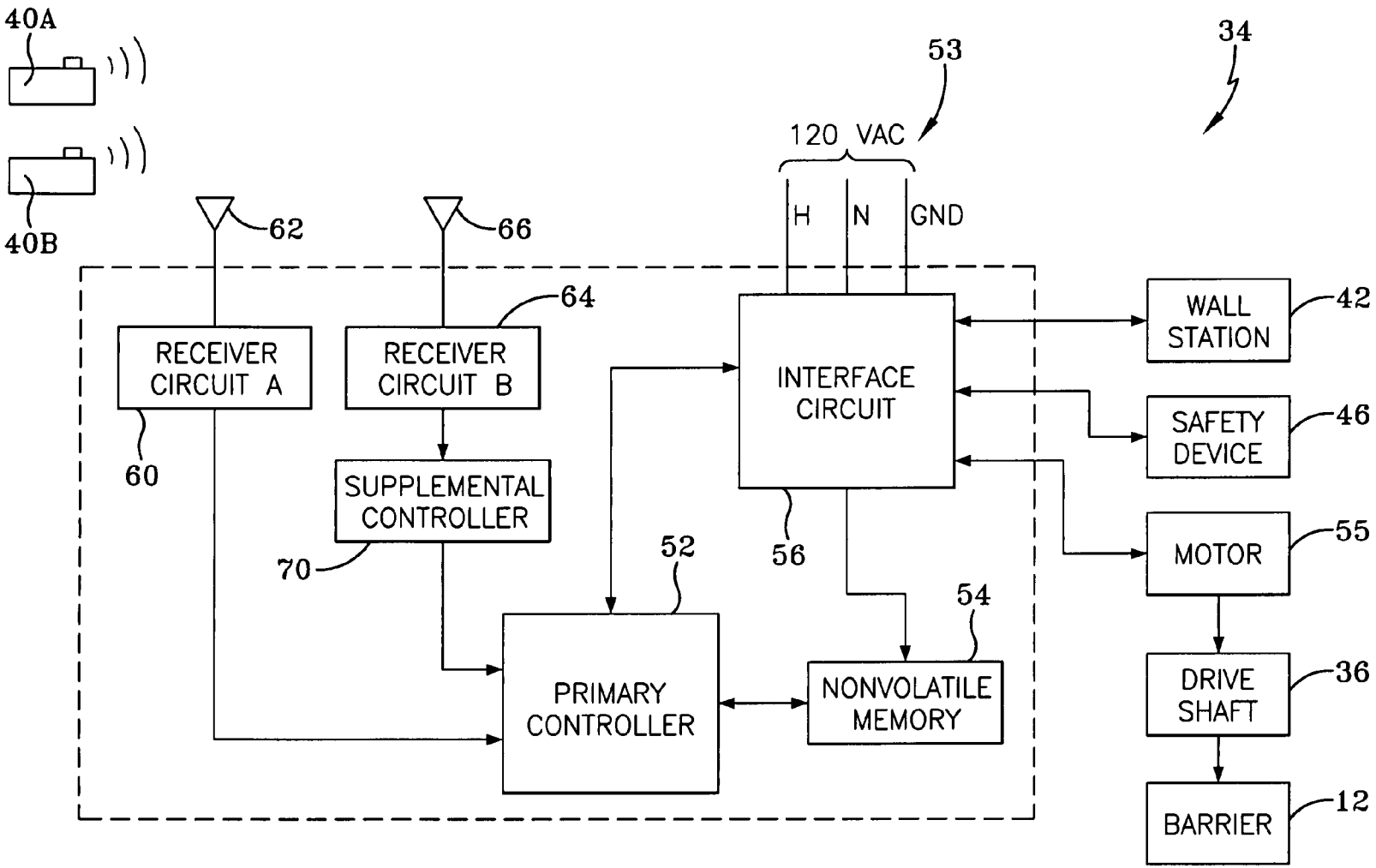
FIG. 3 is a schematic diagram of the operator mechanism in an alternative embodiment.
Figure 4:
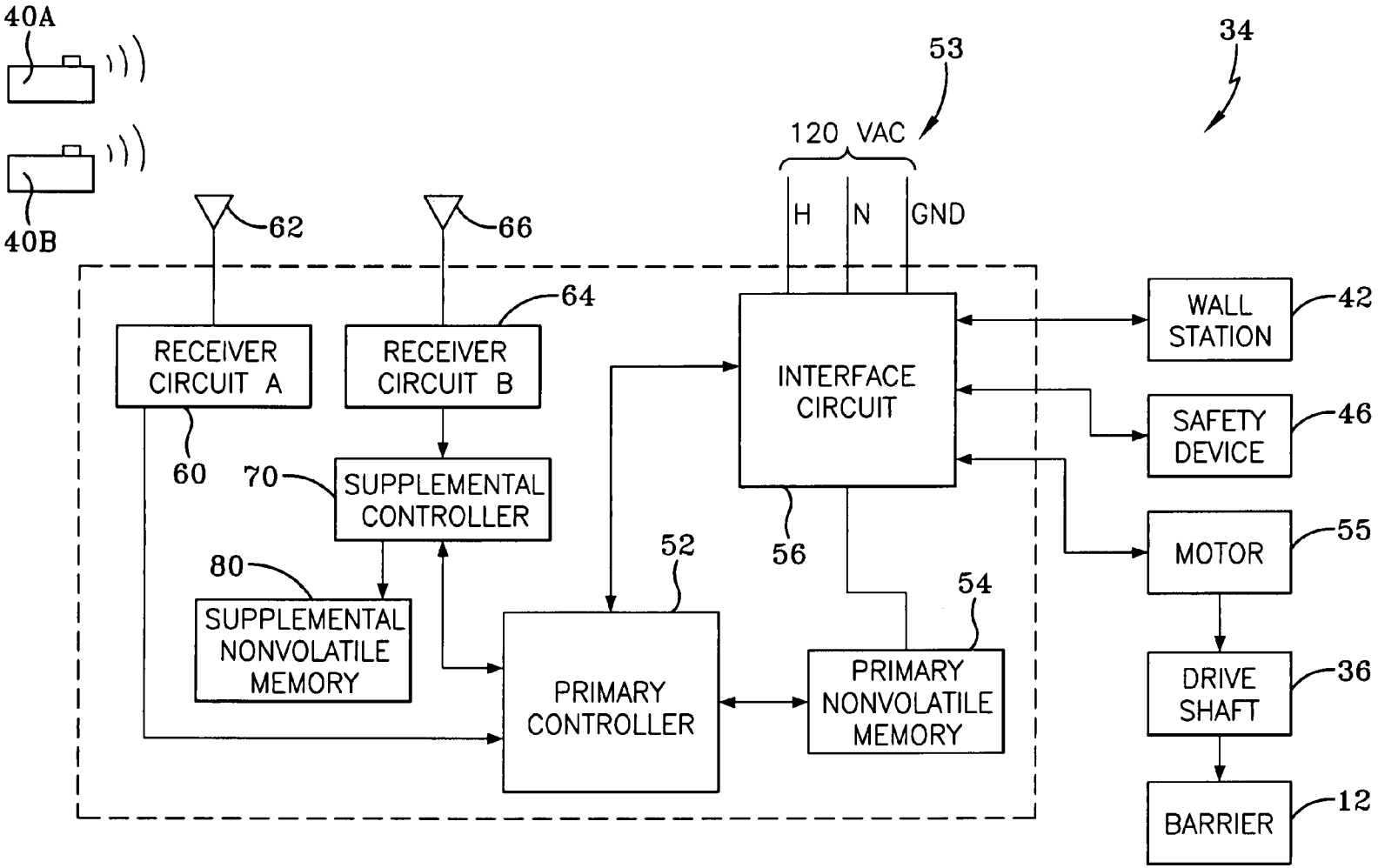
FIG. 4 is a schematic diagram of the operator mechanism in another alternative embodiment.

Referring now to FIGS. 2-4, it can be seen that the operator mechanism 34 employs a controller 52. The mechanism 34 receives power from batteries or some other appropriate power supply 53. As shown, the power supply 53 is a residential power source of 120 Volts AC having hot, neutral and ground connections. The controller 52 includes the necessary hardware, software, and a non-volatile memory device 54 to implement operation of the operator and its related features. It will be appreciated that the memory device 54 may be integrally maintained within the controller 52.

Briefly, when any of the transmitters are actuated, the receiver receives the signal and converts it into a form useable by the controller 52. If a valid signal is received by the controller, it initiates movement of a motor 55 which, in turn, generates rotatable movement of the drive shaft 36 and the barrier 12 is driven in the appropriate direction.

Specifically, referring to FIG. 2 it can be seen that the transmitters are designated with alphabetic suffixes wherein transmitter 40A generates a radio frequency signal, for example, of about 372.5 MHz when actuated and transmitter 40B generates a radio frequency signal of 303.0 MHz when actuated.

The operator mechanism 34 includes, in addition to the primary controller 52, the power supply 53, the primary memory device 54 and the motor 55, an interface circuit 56. The interface circuit 56 assists in coordinating the various inputs and outputs between the components contained within the operator mechanism 34. In particular, the interface circuit 56 receives the power generated by the power supply 53 and transforms it into a voltage value needed for operating additional components within the operator mechanism and for driving the motor 55 in an appropriate manner. The interface circuit 56 also includes an input/output interface for communicating with the various sensors, the controller 52 and the non-volatile memory 54. The interface circuit also provides relay controls for the various components associated with the operator mechanism.

Included within the operator mechanism 34 is a RF receiver circuit 60 that is connected to a controller 52. An antenna 62 is connected to the receiver circuit 60 for the purpose of receiving RF signals generated by the transmitters 40. In a similar manner, a RF receiver circuit 64 is connected to a controller 52. Extending from the receiver circuit 64 is an antenna 66 which receives another frequency signal different than that received by the antenna 62. It will be appreciated that both receiver circuits 60 and 64 send their respective signals, which are representative of their respective transmitters, to a single primary controller 52. As noted previously, the transmitters, instead of using radio frequency signals, may generate infra-red, visible light or acoustic signals to communicate with the operator mechanism. Accordingly, the receiver circuits 64 and 66 and their associated antennas or receiving elements may be configured to receive and process the alternative communication signals. In other words, the receiver circuits 64 and 66 and others, if needed, could receive infra-red, visible light, audible or other wireless type signals corresponding to the types of signals emitted by the transmitters. And the receiving circuits can distinguish between the frequency of the signals received. In any event, the controller distinguishes the signals and their respective formats and generates command signals distributed by the interface circuit.

In the preferred operation, radio frequency data is received at a particular frequency by one of the receivers whereby the controller 52 validates the data, and if required, stores the data in its associated non-volatile memory device 54. In the alternative, the controller 52 may check to determine if the data is already stored in the non-volatile memory device 54. If the data is validated by the controller 52 and already stored within the memory device 54, then the controller communicates with the interface circuit 56 and its associated relay controls to command the motor to move the barrier or to perform other various operational functions. It will be appreciated that the data format for the two radio frequency receivers can be in an identical format, just on different radio frequencies; or the data formats can be totally unique and different from one another. It will be appreciated that more than two receiver circuits could be connected to the controller so as to allow for receipt of more than two different frequency signals.

This embodiment is advantageous inasmuch as it provides two receiver arrangements on a motor control board maintained within the operator mechanism 34. Accordingly, one radio frequency receiver and associated data format can be an older, "legacy" radio frequency and format, while the other receiver is a manufacturer's new radio frequency and data format. In other words, an operator mechanism that employs two different receiver circuits allows for pre-existing radio frequency transmitters to be used with the new system. Accordingly, the operator mechanism 34 can operate from both the old-style, old RF remote controls and any new-style, new RF remote controls. This allows for newly produced motor control boards, with both RF receivers 60 and 64, to be a service or replacement board for older products. This also allows for the upgrade of an older motor control board to a newer motor control board which may provide new or enhanced features associated with the wall station or possibly a home network, without having to change the user's older remote controls to the newer frequencies or data format. Yet another advantage of the present embodiment is that it allows for the motor control board to have radio frequency receivers and data formats that operate from two different manufacturer's remote controls. In other words, one RF receiver may be employed for one manufacturer's transmitters while the other receiver is associated with some other manufacturer's remote controls.

Referring now to FIG. 3, it can be seen that modifications may be made to the operator mechanism 34. In particular, a supplemental controller 70 may be interposed between one of the RF receiver circuits and the primary controller 52. Accordingly, each radio frequency receiver circuit has its own dedicated controller. In other words, the receiver circuit 64 has a dedicated controller 70 while receiver circuit 60 employs the primary controller 52.

This embodiment has all the advantages of the previously described embodiment, but incorporates two controllers. The advantage of having two controllers is that the receiver 64 can contain third-party confidential software code that has not been released to the software writers of the primary controller 52. In addition, use of the supplemental controller allows for off-loading of some of the work requirements from the primary controller to the secondary controller allowing each controller to respond more quickly to the received commands. Yet another advantage of this embodiment is that it allows for the software creation and writing tasks to be simpler with two controllers, wherein each controller is dedicated to a specific data format.

Yet another embodiment is shown in FIG. 4, where it can be seen that a supplemental controller 70 is connected to a dedicated supplemental non-volatile memory device 80. Accordingly, each controller has its own dedicated memory device. The advantages in this particular embodiment are that each controller's non-volatile memory may be contained within the controller device's package, thus the one controller cannot communicate with the other controller's memory device. This insures accuracy and efficient data transfer between the respective devices. It also permits different and unique memory storage techniques that may facilitate operation of a operator mechanism that receives multiple frequencies.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A barrier operator system adapted to receive different wireless frequency signals from different frequency transmitters so as to move a barrier between limit positions, the system comprising:

a primary controller which initiates and controls movement of a single barrier;

a first receiver circuit directly receiving only a first wireless frequency signal from a first transmitter from which said first wireless frequency signal originates and electrically connected to said primary controller; and a second receiver circuit directly receiving only a second wireless frequency signal from a second transmitter from which said second wireless frequency signal originates and electrically connected to said primary controller, wherein both said receiver circuits and said primary controller are maintained within an operator mechanism, and wherein said first wireless frequency signal is different than said second wireless frequency signal, and wherein said primary controller validates said first and second wireless frequency signals and subsequently initiates over a wired secure connection an operational function of said operator mechanism including moving said barrier.

2. The system according to claim 1, further comprising:

a powered interface circuit connected to said primary controller and maintained within said operator mechanism, wherein said primary controller distinguishes said wireless frequency signals and sends command signals distributed by said interface circuit, said interface circuit transforming the supplied power into a voltage value in response to the receipt of said command signals.

3. The system according to claim 2, further comprising:

a motor connected to said interface circuit for receiving said command signals, and said voltage value to move the barrier between limit positions.

4. The system according to claim 2, further comprising:

a supplemental controller connected to one of said receiver circuits and to said primary controller and maintained within said operator mechanism, wherein said supplemental controller generates command signals that are passed through said primary controller to said interface circuit.

5. The system according to claim 4, wherein said primary controller has a primary data format different from a supplemental data format utilized by said supplemental controller.

6. The system according to claim 4, further comprising:

a primary memory device connected to said primary controller and maintained within said operator mechanism; and a supplemental memory device connected to said supplemental controller and maintained within said operator mechanism so as to separate data processing of both said primary and supplemental controllers from each other.

7. The system according to claim 1, wherein said first and second receiver circuits receive radio frequency signals, and wherein said first wireless frequency signal is at a frequency distinguishable from said second wireless frequency signal.

8. The system according to claim 7, wherein said first and second wireless frequency signals are radio frequency signals between about 300.00 MHz and about 450.0 MHz.

9. The system according to claim 1, wherein said wireless frequency signals are selected from the group consisting of radio frequency, infra-red, visible light and audible.

10. The system according to claim 1, wherein said receiver circuits receive said wireless frequency signals that are selected from the group consisting of radio frequency, infra-red, visible light and audible.

11. The system according to claim 10, wherein said first receiver circuit receives one type of said wireless frequency signals and said second receiver circuit receives another type of said wireless frequency signals.

12. The system according to claim 10, wherein said first and second receiver circuits receive the same type of wireless frequency signals, and wherein the same type of wireless frequency signals are at distinguishable frequencies.

13. A method for communicating wireless frequency signals from a plurality of wireless frequency transmitters to a barrier operator system which controls the movement of a barrier between limit positions, the method comprising:

maintaining an operator mechanism having a primary controller;

receiving at least two different wireless frequency signals directly from the wireless transmitters from which said wireless frequency signals originate, wherein a first receiver circuit receives only a first wireless frequency signal and a second receiver circuit receives only a second wireless frequency signal, said receiver circuits electrically connected to said primary controller and maintained within said operator mechanism;

validating at least one of said received wireless frequency signals;

processing said validated wireless frequency signals; and sending command signals from said primary controller to a powered interface circuit over a wired secure connection, said interface circuit transforming supplied power into a voltage value to initiate movement of the motorized barrier.

14. The method according to claim 13, further comprising:

generating said command signals in a format compatible with a motor that moves the barrier between limit positions.

15. The method according to claim 14, further comprising:

processing one of said received wireless frequency signals in a supplemental controller which is linked between said respective receiver circuit and said primary controller and maintained within said operator mechanism.

16. The method according to claim 15, further comprising:

accessing a primary memory device connected to said primary controller to validate any of said wireless frequency signals not processed by said supplemental controller; and accessing a supplemental memory device connected to said supplemental controller to validate any of said wireless frequency signals processed by said supplemental controller.

17. The method according to claim 15, further comprising:

accessing a primary memory device connected to said primary controller to validate any of said wireless frequency signals received by said first and second receiver circuits.

18. The method according to claim 13, wherein said receiving step comprises receiving wireless frequency signals selected from the group consisting of radio frequency, infra-red, visible light and audible.

19. The method according to claim 18, wherein said receiving step further comprises:

receiving one type of said wireless frequency signal in said first receiver circuit; and receiving another type of said wireless frequency signal in said second receiver circuit.

20. The method according to claim 18, wherein said receiving step further comprises:

receiving one type of said wireless frequency signal having a first frequency in a first receiver; and receiving said one type of said wireless frequency signal having a second frequency in a second receiver, wherein said second frequency is distinguishable from said first frequency.

21. The method according to claim 20, receiving said first and second frequencies in a frequency range of about 300.0 MHz to about 450.0 MHz.

* * * * *